US005269741A

United States Patent [19]

Fischer

[11] Patent Number: 5,269,741

[45] Date of Patent: Dec. 14, 1993

[54] PROCESS AND MACHINE FOR ERECTING A FOLDING CARTON

[76] Inventor: Wilhelm Fischer, D-8968 Weidacher Strasse 1-3, Durach, Fed. Rep. of Germany

[21] Appl. No.: 746,320

[22] Filed: Aug. 16, 1991

[30] Foreign Application Priority Data

Aug. 30, 1990 [DE] Fed. Rep. of Germany ..... 4027395

[51] Int. Cl.[5] ..... B31B 3/30; B31B 3/64; B65B 43/26

[52] U.S. Cl. ..... 493/143; 493/167; 493/182

[58] Field of Search ..... 493/143, 167, 172, 173, 493/178, 174, 182

[56] References Cited

U.S. PATENT DOCUMENTS

| | | | |
|---|---|---|---|
| 1,843,027 | 1/1932 | Jahne | 493/172 |
| 1,978,057 | 10/1934 | Paridon | 93/51 |
| 2,599,008 | 6/1952 | Palmer | 493/172 |
| 2,600,954 | 6/1952 | Bardet | 493/172 |
| 3,394,635 | 7/1968 | Hoyrup et al. | 493/167 |
| 3,683,755 | 8/1972 | Lattke | 493/143 |
| 3,817,682 | 6/1974 | Lefebvre | 431/6 |
| 4,917,663 | 4/1990 | Pazdernik | 493/317 |

FOREIGN PATENT DOCUMENTS

| | | | |
|---|---|---|---|
| 715120 | 11/1931 | France | 493/173 |
| 745709 | 7/1980 | U.S.S.R. | 493/173 |
| 384322 | 11/1932 | United Kingdom | 493/172 |

*Primary Examiner*—William E. Terrell
*Attorney, Agent, or Firm*—Collard & Roe

[57] ABSTRACT

Process for erecting a folding carton from a single-piece board blank which has a base surface, to which side panels are hinged along folding lines, and a front and back panel, where flaps are provided on the side panels that are folded into the area of the front and back panels, and where at least sections of the blanks are coated with a sealable plastic. First of all the two side panels are erected by pressing the board blank into a U-shaped female tool. Rotating lugs fold in the flaps; the back and front panels are heated up to such an extent that the plastic coating is sealable, after which the back panel and the front panel and the flaps are pressed against each other and are sealed together.

14 Claims, 6 Drawing Sheets

PROCESS AND MACHINE FOR ERECTING A FOLDING CARTON

Figure 1:
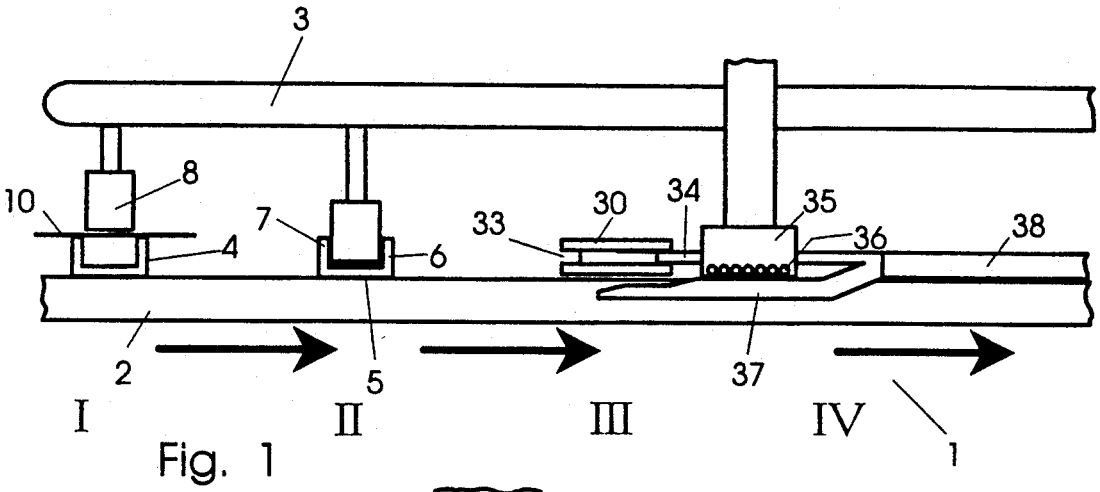

The invention relates to a process and a machine for erecting a folding carton from a single-piece board blank which has a base surface, to which side panels are hinged along folding lines, and a front and back panel, where flaps are provided on the side panels that are folded into the area of the front and back panels, and where at least sections of the blank are coated with a sealable plastic.

Since large numbers of such folding cartons are used, they need to be erected quickly. However, the quality of the erection operation does at the same time have to be high, so that dimensionally accurate folding cartons are produced.

The purpose of the invention is to suggest a process and a machine with which the erection operation can be carried out very precisely and at the same time very quickly.

In the solution to this problem proposed by the invention, first of all the two side panels are erected by pressing the board blank into a U-shaped female tool, rotating lugs fold in the flaps and the back and front panels are heated up to such an extent that the plastic coating is sealable, after which the back panel and the front panel and the flaps are pressed against each other and are sealed together.

This process leads to the extremely efficient production of exactly and uniformly erected folding cartons.

It is provided in an advantageous version of the invention that following the erection of the two side panels the flaps designed as dust flaps are first of all folded in by rotating lugs and then the back panel and front panel are pressed against and sealed to these dust flaps.

A very stable and to a large extent tight folding carton can be produced very efficiently as as result.

In another very advantageous development of the invention it is provided that following the erection of the two side panels, the end panels are folded into place then the gusset sections and the end panels are heated and folded. The folded sections are pressed and sealed together by pressure bars to form gussets.

The folding carton produced in this way is not only very precise but also tight, while the erection operation can also be carried out at very high speed.

In a machine designed in accordance with the invention to erect a folding carton from a single-piece board blank which has a base surface, to which side panels are hinged along folding lines, and a front and back panel, between which and the side panels dust flaps are provided, and which is coated with a sealable plastic at least on the side that will form the inside of the carton, a U-shaped female tool attached to a transport chain is provided, which has a base plate and a front and back section, this female tool has a male tool allocated to it that is attached to another chain, closing wheels with a recess at one point are provided on both sides of these transport chains to fold in the dust flaps, following which holding bars for the folded-in dust flaps are located, a hot air nozzle the openings of which are directed towards the inside of the front and the back panel is provided on both sides following the closing wheels and pressure bars to position and press the front and back panels against the dust flaps are provided after the hot air nozzles.

This machine makes it possible to carry out the operation of erecting a folding carton functionally effectively, while the very precise production of the folding carton can be combined with a very high operating speed.

In a further machine designed in accordance with the invention to erect a folding carton from a single-piece board blank which has a base surface, to which side panels are hinged along folding lines, and a front and back panel, where flaps that are also connected to the other two panels forming gussets are provided on the two side panels. A U-shaped female tool is attached to a transport chain which has a base plate and a front and back section, this female tool has a male tool allocated to it that is attached to another chain bars for folding in the front and back panel are provided on both sides of these transport chains following the male and female tool. The bars are followed by hot air nozzles for heating up the outside of the front and back panels. Closing wheels with a recess at one point fold the flaps and pressure bars press the flaps against the gussets.

With this machine it is possible to produce tight folding carton trays extremely precisely and at high speed.

It is also very advantageous if in accordance with the invention the two closing wheels are provided with a groove around their circumference, which preferably extends to the base of the recess and which the holding bars can engage.

In this way the holding bars can be extended so that they complement the closing wheels appropriately.

It is also very advantageous if in accordance with the invention the pressure bars have recesses in which spring-loaded pressure rollers are located.

This means not only that the pressure application operation is very gentle on the material but also that the pressure level is easy to adjust.

It has proved to be very favourable in this context if in accordance with the invention levers are pivoted on the underneath of the pressure bars, which springs engage and which support the pressure rollers.

It has also proved to be very advantageous if in accordance with the invention the male tool is guided in a rail which automatically sets the distance between the male tool and the base-plate of the female tool.

This arrangement makes further control devices for the male tool unnecessary.

Figure 2:
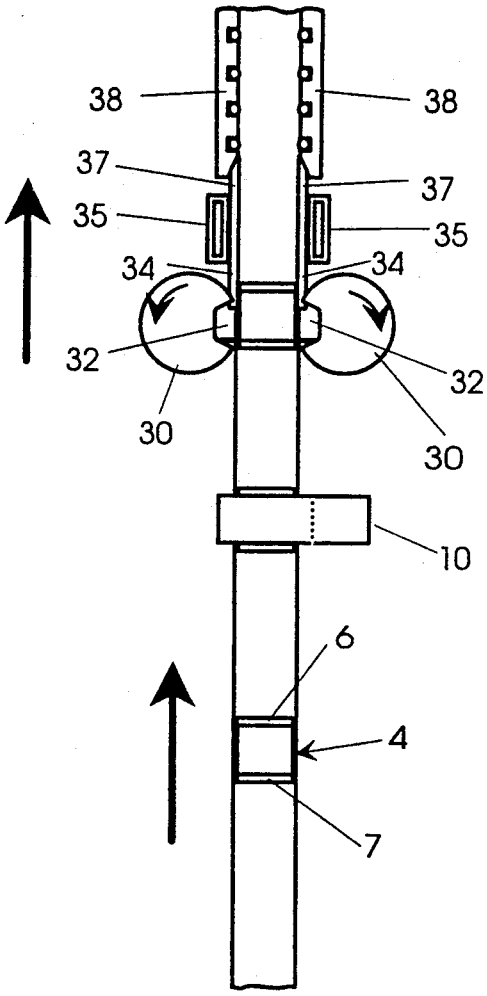
Figure 3A:
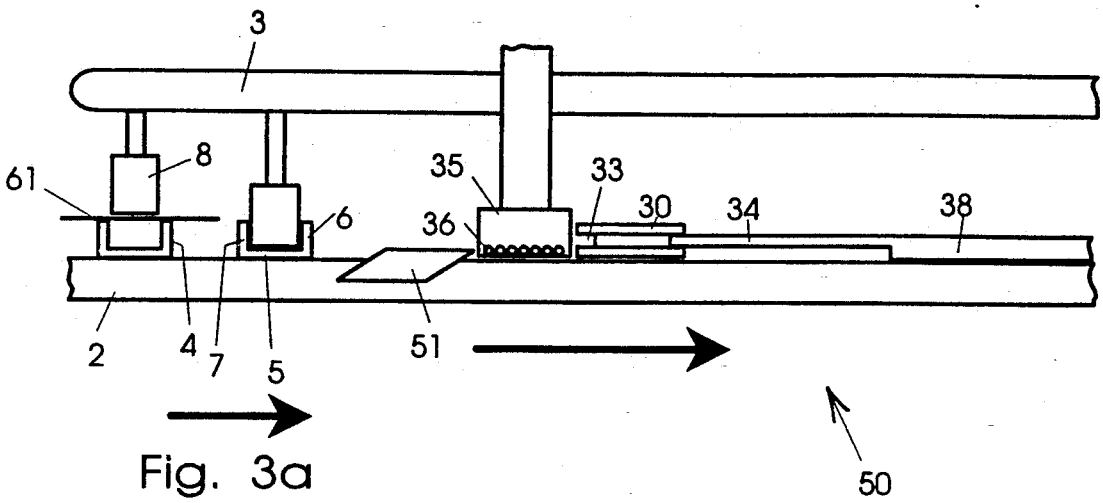
Figure 3B:
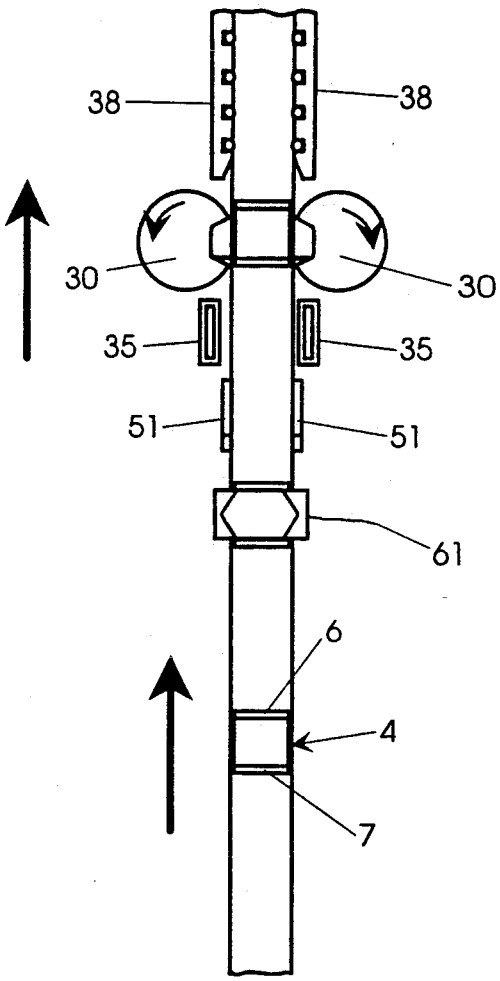
Figure 4A:
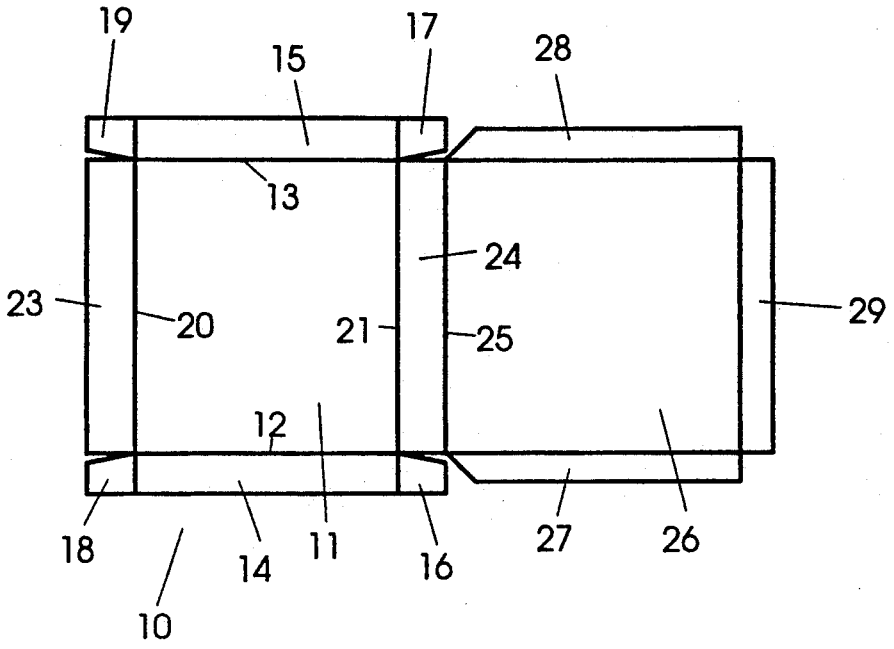
Figure 4B:
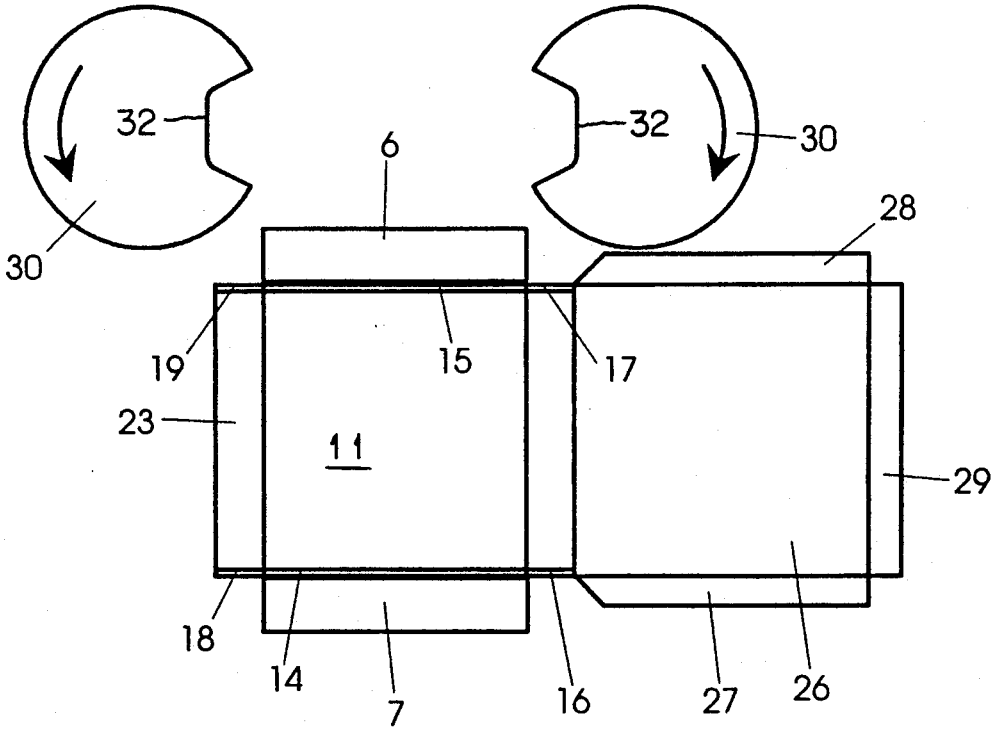
Figure 4C:
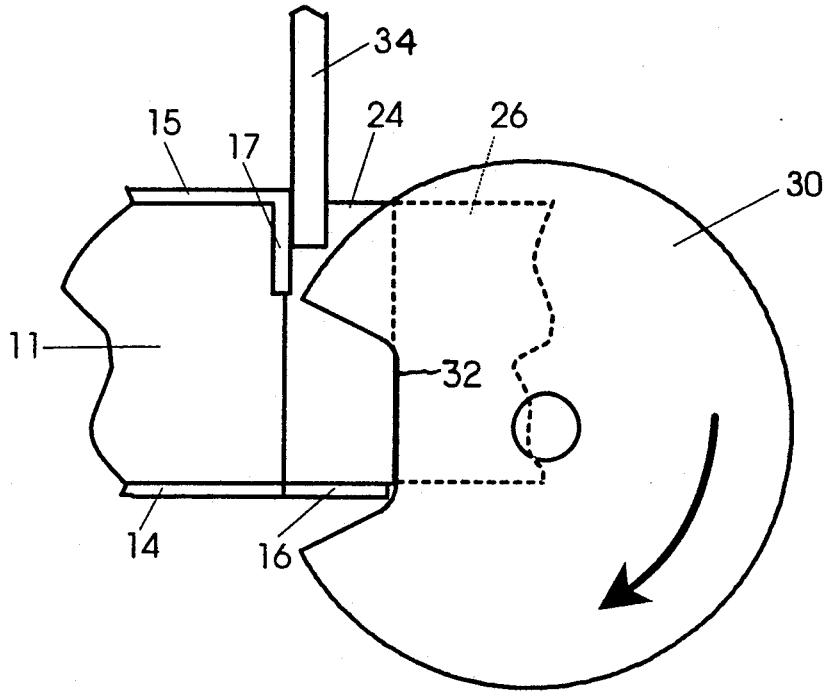
Figure 5A:
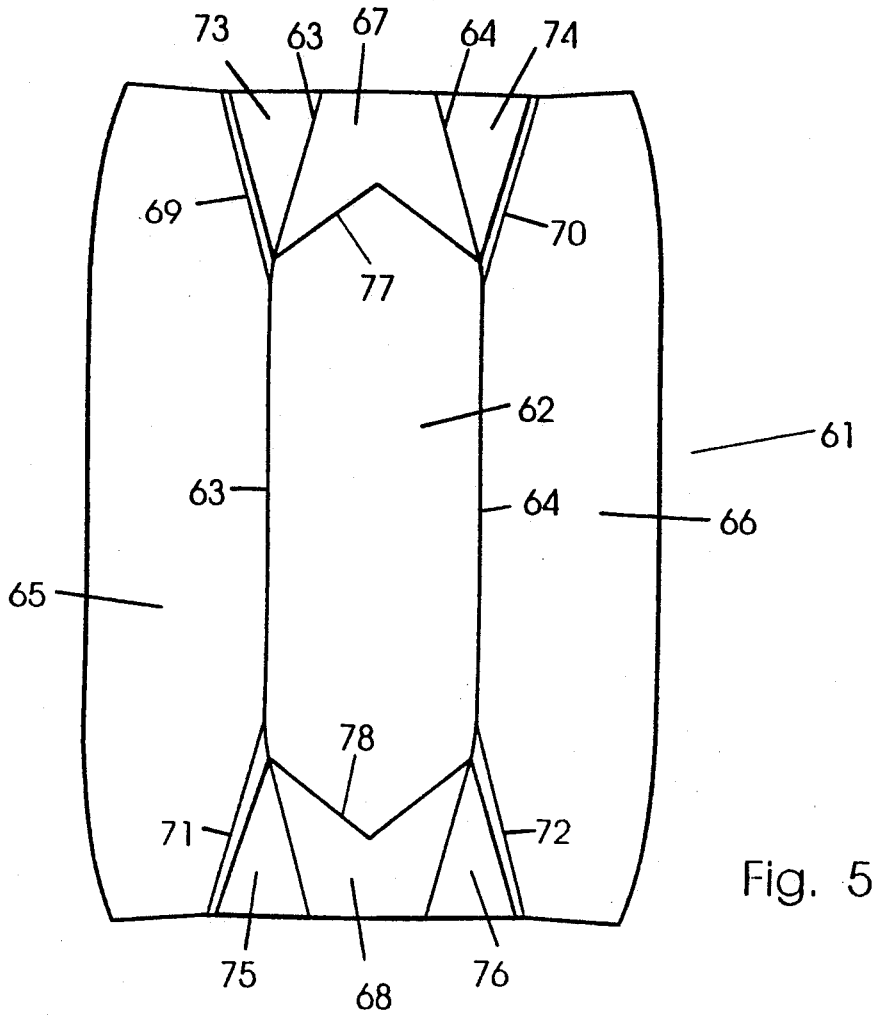
Figure 5B:
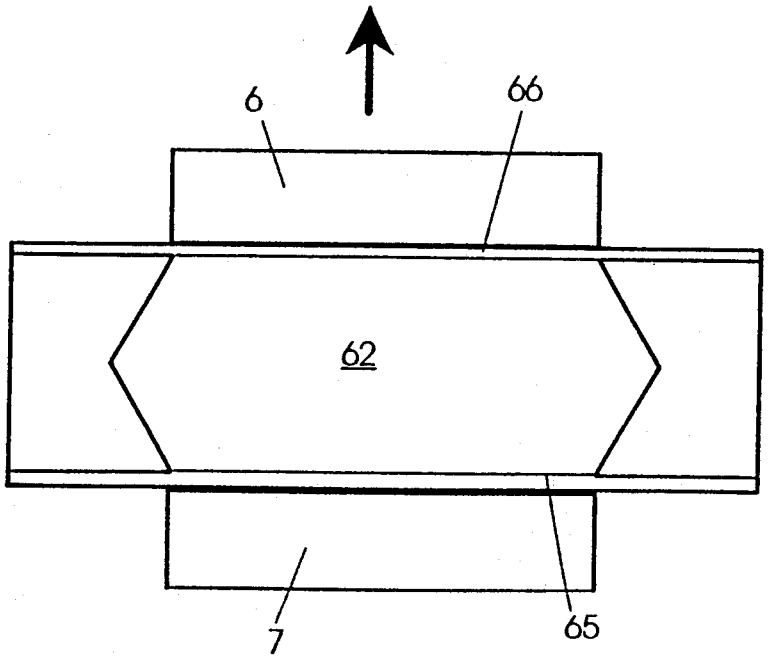
Figure 5C:
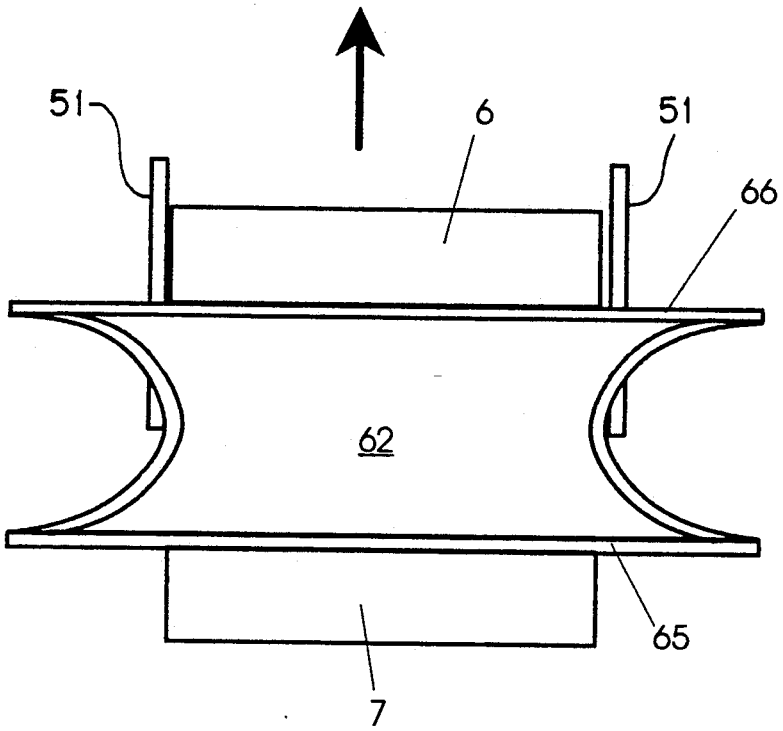

Several embodiments of the invention are illustrated in the drawings:

FIG. 1 is a diagrammatic side view of a machine for erecting a folding carton, with two transport chains for a male forming tool, a U-shaped female tool and two closing wheels, FIG. 2 is a top view of the machine illustrated in FIG. 1, showing the roller section, FIGS. 3*a* and 3*b* are diagrammatic side and top views of a further machine for erecting a tight folding carton tray, FIGS. 4*a*, 4*b* and 4*c* are views of a board blank being operated on in the machine illustrated in FIGS. 1 and 2, FIGS. 5*a*, 5*b* and 5*c* are views of a board blank being operated on in the machine illustrated in FIGS. 3, FIG. 6 shows a folding carton tray erected from the blank illustrated in FIG. 5 and FIGS. 7 show details of the roller section on an enlarged scale.

1 is a machine for erecting a folding carton, which has two transport chains 2 and 3. Numerous U-shaped female tools 4, which circulate with the transport chain and each have a base plate 5 and a front and back section 6, 7, are attached to the lower transport chain 2.

Each of these U-shaped female tools 4 has a male tool 8 allocated to it that is attached to the upper transport chain 3 and circulates with it. A guide rail, which determines the vertical position of the male tool and makes sure it engages the U-shaped female tool, is provided within the upper transport chain 3.

A board blank 10, as illustrated in FIG. 4, is placed between the female tool 4 and the male tool 8. This board blank has a base 11, to which side panels 14/15 are hinged along folding lines 12 and 13. Each of these two side panels 14/15 has a dust flap 16, 17 and 18, 19 at each side, which are hinged to the two side panels along folding lines 20 and 21. A front panel 23 and a back panel 24 are also hinged to the base 11 along these folding lines 20, 21. A top panel 26, which has side panel flaps 27, 28 and a front panel flap 29—that cover the two side panels 14, 15 and the front panel 23 when the folding carton has been erected completely -, is connected to the back panel 24 along a further folding line 25.

Two closing wheels 30, also referred to as rotating lugs, which turn in opposite directions and are provided with a recess 32, are located next to the lower transport chain 2. Each of the two closing wheels also has a groove 33 around its circumference, which one end of a subsequent folding bar 34 engages. A hot air nozzle 35, the openings 36 of which are on the opposite side from the folding bar 34, is located next to this folding bar 34. A further folding bar 37, which extends from below the closing wheels 30 at least to the level of the first folding bar 34 and is followed by a pressure bar 38, is located on the opposite side of the hot air nozzle 35 from this folding bar 34.

As can be seen in FIG. 2, not only the closing wheels 30 but also the folding bars 34 and 37, the hot air nozzles 35 and the pressure bars 38 are located on both sides of the transport chains 2 and 3.

The pressure bar 38 is provided with pivoted pressure rollers 39, which are located in appropriate recesses 40 in the pressure bar and are fitted on levers 41 attached to the underneath of the bar. The levers are engaged by springs (not visible in the drawings), which press the levers—and thus the rollers—outwards.

When the male tool is lowered, it presses the base 11 of the board blank 10 shown in FIG. 4 into the U-shaped female tool 4, so that the two side panels 14 and 15 point vertically upwards and are clamped between the two sections 6, 7 and the male tool. The dust flaps 16, 17, 18, 19 point out of the sides of the female tool 4. When the female tool reaches the closing wheels 30, the two front dust flaps 17 and 19 are folded against the male tool 8 by the wheels and are held in this position by the folding bars 34. The two back dust flaps 16 and 18 are engaged by the recess 32 in the two closing wheels 30, are also folded against the male tool by the turning movement of the wheels and are then held in this position by the folding bars 34. The folding bars 37 lift the front panel 23 and the back panel 24 slightly, so that the hot air is directed against the inside of these two panels—both of which are coated with sealable plastic—when it leaves the hot air nozzles 35 / the openings 36 in them. In further operations the two folding bars 37 press these two panels upwards until they rest against the dust flaps, while the actual pressure application operation is carried out by the subsequent pressure bars 38 / their pressure rollers 39, which are located directly after the folding bars 37. Since these pressure rollers are spring-loaded, they can even compensate for slight differences in material thickness.

The machine 50 illustrated in FIG. 3 corresponds to a large extent to the machine 1 described above. The only differences are that the hot air nozzles 35 are located before the closing wheels 30 and a bar 51 to fold in the front and back panel of the blank 61 illustrated in FIG. 5 and of the folding carton tray 80 erected from it (FIG. 6) is also located on each side of the transport chains 2, 3 before the hot air nozzles.

The flat board blank 61 illustrated in FIG. 5 has a base section 62, to which side panel sections 65 and 66 are hinged along folding lines 63 and 64. The base section is also provided with two end panel sections 67 and 68, also referred to as front and back panels which are also connected to the side panel sections 65 and 66 along the folding lines 63 and 64. Two further folding lines 69, 70 and 71, 72 extend from each of the two folding lines 63 and 64, as a result of which gusset sections 73, 74, 75, 76 are divided off between the side panel sections and the end panel sections. The outside and inside of these gusset sections 73 to 76 and the section of the relevant end panel section 67/68 divided off by the line 77/78 are provided with a sealable plastic layer, which is shown by the shaded area in FIG. 5. To erect this board blank 61 into the tub-like tray 80 illustrated in FIG. 6, first of all the two side panel sections 65 and 66 are folded upwards along the folding lines 63 and 64 by pushing the blank into the U-shaped female tool. The two end panel sections 67 and 68 are then folded upwards by the folding bar 51. After they have been heated up by the hot air nozzles 35, the gusset sections and the end sections of the side panel sections are folded on the outside by the closing wheels, after which all three layers are pressed and sealed together by the pressure bars 38.

I claim:

1. An apparatus for erecting a folding carton from a single-piece board blank with an inside, an outside, a base surface, side panels hinged to the base surface along folding lines, a front panel, a back panel, and dust flaps located adjacent the side panels, the blank is coated with sealable plastic on at least the inside, comprising:

a U-shaped female tool having a base plate, a front section, a back section, and a first transport chain attached thereto with a downstream direction of travel;

a male tool corresponding to said U-shaped female tool having a second transport chain located above said first transport chain, said male tool being attached to said second transport chain and erecting the side panels by pressing the board blank into said U-shaped female tool;

two closing wheels each with a recess for folding the dust flaps as the board blank and said chains pass between said two closing wheels;

two holding bars located downstream of said two closing wheels for holding the dust flaps in their folded position;

two hot air nozzles each with an opening directed toward the inside of the front and back panels to heat said plastic until it is sealable, said nozzles being located downstream of said holding bars; and two pressure bars located downstream of said two hot air nozzles to position, press and seal the front and back panels against the dust flaps.

2. The apparatus according to claim 1, wherein said two closing wheels are provided with a groove around their circumference, which extends to the base of the recess for engaging said holding bars.

3. The apparatus according to claim 1, wherein said two pressure bars have recesses and spring-loaded pressure rollers located within the recesses.

4. The apparatus according to claim 1, additionally including levers having springs pivoted on the underneath of said two pressure bars, said springs engage and support said pressure rollers.

5. The apparatus according to claim 1, additionally including a rail to guide said second transport chain and said male tool to automatically set the distance between said male tool and the base plate of said female tool.

6. An apparatus for erecting a folding tray from a single-piece board blank with an inside, an outside, a base surface, side panels hinged to the base surface along folding lines, a front panel, a back panel, sections connected the side panels between and the front and back panel, and a sealable plastic placed on preselected sections of the board blank comprising:

a U-shaped female tool having a base plate, a front section, a back section, and a first transport chain attached thereto with a downstream direction of travel;

a male tool corresponding to said U-shaped female tool having a second transport chain located above said first transport chain, said male tool being attached to said second transport chain and erecting the side panels by pressing the board blank into said U-shaped female tool;

two holding bars for folding in the front and back panels as the board blank and said chains pass between said two holding bars;

two hot air nozzles located downstream of said two holding bars for heating the outside of the front and back panels and the flaps until the plastic is sealable;

two closing wheels located downstream of said two hot air nozzles for folding the flaps onto the front and back panels forming gussets; and two pressure bars located downstream of said two closing wheels for pressing and sealing the flaps against the gussets and the front and back panels.

7. The apparatus according to claim 6, wherein said two closing wheels are provided with a groove around their circumference, which extends to the base of the recess for engaging said holding bars.

8. The apparatus according to claim 6, wherein said two pressure bars have recesses and spring-loaded pressure rollers located within the recesses.

9. The apparatus according to claim 6, additionally including levers having springs pivoted on the underneath of said two pressure bars, said springs engage and support said pressure rollers.

10. The apparatus according to claim 6, additionally including a rail to guide said second transport chain and said male tool to automatically set the distance between said male tool and the base plate of said female tool.

11. A process for erecting a carton from a single-piece board blank with an inside, an outside, a base surface, side panels hinged to the base surface along folding lines, a front panel, a back panel, flaps connected to the side panels, and a sealable plastic placed on preselected sections of the board blank comprising the steps of:

pressing the board blank into a U-shaped female tool with a corresponding male tool to erect the side panels, the female and male tools being attached to separate transport chains, both located in a vertical plane;

folding in the flaps with devices located either side of the transport chains;

heating the front and back panels to make the plastic sealable folding in the front panel and the back panel; and pressing the front and back panels against the flaps until they are sealed together.

12. The process for erecting a carton according to claim 11, wherein said step of folding in the flaps includes folding in dust flaps with rotating lugs, and said step of pressing the front and back panels includes pressing the front and back panels against the dust flaps until they are sealed together.

13. A process for erecting a tray from a single-piece board blank with an inside, an outside, a base surface, side panels hinged to the base surface along folding lines, a front panel, a back panel, sections connected between the side panels and the front and back panel, and a sealable plastic placed on preselected sections of the board blank, comprising the steps of:

pressing the board blank into a U-shaped female tool with a corresponding male tool to erect the side panels, the female and male tools being attached to separate transport chains, both located in the vertical plane;

folding in the front panel and the back panel;

heating the front panel, the back panel and the sections to make the plastic sealable;

folding in the sections against the front and back panels with devices located on either side of the transport chains; and pressing the sections against the front and back panels until they are sealed together.

14. The process for erecting a carton according to claim 13, wherein said step of folding in the sections includes folding in the sections with rotating lugs against the front and back panels to form gussets; and said step of pressing the sections includes pressing the sections against the front and back panels until the gussets are sealed to the front and back panels.

* * * * *